United States Patent [19]

Büehler et al.

[11] Patent Number: 4,612,534

[45] Date of Patent: Sep. 16, 1986

[54] METHOD OF TRANSMITTING MEASURING VALUES IN A MONITORING SYSTEM

[75] Inventors: Richard Büehler, San Diego, Calif.; Jürg Muggli, Männedorf, Switzerland; Andreas Scheidweiler, Jona, Switzerland; Eugen Schibli, Uerikon, Switzerland

[73] Assignee: Cerberus AG, Männedorf, Switzerland

[21] Appl. No.: 494,966

[22] Filed: Apr. 19, 1983

[30] Foreign Application Priority Data

Apr. 28, 1982 [CH] Switzerland ..... 2589/82

[51] Int. Cl.[4] ..... G08B 26/00

[52] U.S. Cl. ..... 340/505; 340/508; 340/511; 340/518; 340/825.54

[58] Field of Search ..... 340/505, 508, 518, 531, 340/825.05–825.13, 825.15, 825.5, 511, 825.54, 825.52

[56] References Cited

U.S. PATENT DOCUMENTS

| | | | |
|---|---|---|---|
| 4,263,580 | 4/1981 | Sato | 340/644 |
| 4,290,055 | 9/1981 | Furney et al. | 340/505 |
| 4,400,694 | 8/1983 | Wong et al. | 340/505 |
| 4,404,548 | 9/1983 | Muller et al. | 340/505 |
| 4,413,259 | 11/1983 | Lutz et al. | 340/518 |
| 4,468,664 | 8/1984 | Galvin et al. | 340/505 |

FOREIGN PATENT DOCUMENTS

| | | |
|---|---|---|
| 0042501 | 12/1981 | European Pat. Off. . |
| 2533382 | 7/1980 | Fed. Rep. of Germany . |
| 2121318 | 7/1972 | France . |

OTHER PUBLICATIONS

Technische Mitteilung—AEG-Telefunken, vol. 61, No. 6, 1971.

*Primary Examiner*—Donnie L. Crosland
*Attorney, Agent, or Firm*—Werner W. Kleeman

[57] ABSTRACT

Measuring stations or locations are connected in cascade to signal lines and transmit measured or measuring values to a central signal station at which the measured values are linked or appropriately processed so as to obtain distinct malfunction or alarm signals. Upon activation of the monitoring system all measuring stations are disconnected by a change in voltage appearing on the signal line. Then, the measuring stations are reconnected to the signal line in a timewise staggered fashion by means of switching elements present at each measuring station in such a manner that each measuring station additionally reconnects a subsequent measuring station to the line voltage after a predetermined time-delay. Address storages are present at the measuring stations and are charged or occupied in a predetermined sequence by the central signal station with addresses associated with the individual measuring stations. The address storages are thereafter locked prior to the time that the next following measuring station at the same signal line is connected to the signal voltage by the switching element.

10 Claims, 4 Drawing Figures

METHOD OF TRANSMITTING MEASURING VALUES IN A MONITORING SYSTEM

CROSS-REFERENCE TO RELATED APPLICATION

This application is related to the commonly assigned, copending U.S. application Ser. No. 271,187, filed June 8, 1981, and entitled "Method for Transmitting Measuring Values in a Fire Alarm System and Apparatus for Performance of the Aforesaid Method", granted as U.S. Pat. No. 4,404,548 on Sept. 13, 1983.

BACKGROUND OF THE INVENTION

The present invention relates to a new and improved method of transmitting measured or measuring values in a monitoring system.

In its more specific aspects, the present invention relates to a new and improved method of transmitting measuring or measured values in a monitoring system in which measured values determined by individual measuring stations or locations which are connected in cascade to signal lines and serving for monitoring purposes are transmitted to a number of first pairs of terminals at a central signal station. At the central signal station the measured values are then linked or processed in order to obtain differentiated or distinct malfunction or alarm signals. Furthermore, upon activation or placement into operation all measuring stations are disconnected from the signal line by a voltage change. Afterwards, the measuring stations are reconnected in a time-wise staggered fashion to the signal line by means of switching elements present at each measuring station in such a manner that each measuring station additionally reconnects the next following measuring station to the line voltage after a predetermined time-delay.

To solve a multiplicity of monitoring tasks measuring stations are distributed throughout expansive structures or objects and are connected to a central signal station via a signal line. In this connection it becomes increasingly important to exactly know the origin of the measured or measuring data in order to satisfy the requirements of intelligent signal processing.

In principle, identification of the measuring stations or locations can be obtained in three different ways. The oldest known method which, however, presently finds very little use, consists of stringing individual lines from each measuring station to the central signal station. However, this solution requires an extremely high installational expense. More modern systems make use of the principle of a cascade connection in which the measuring stations are series connected and the identification is obtained by counting corresponding stepping pulses (see FIG. 1). Alternatively, fixedly addressed individual measuring stations are used which are connected in parallel to the line (see FIG. 2). A known method based on the cascade or tandem connection principle as shown in FIG. 1 is described in German Pat. No. 2,533,382, published Oct. 21, 1976. The essential difference between the two last mentioned methods is that according to the cascade connection principle all measuring stations may be identical, whereas in the system with parallel arrangement the measuring stations differ by virtue of their address and they are distinguished either by means of switches or other programming aids or accessories. It will be clear that from the view point of mass production as well as servicing and maintenance identical measuring stations have decisive advantages, and additionally, preclude the danger of any mix-up and faulty addressing. On the other hand, the fixedly impressed address affords a greater operational integrity as concerns the correct identification of the measuring stations. The known methods for identifying measuring stations in transmission systems have the following disadvantages:

(1) higher installational expense, (2) uncertainty in the identification of the measuring stations in the case of cascade connections, and (3) different measuring stations in a system with parallel connection.

SUMMARY OF THE INVENTION

Therefore, with the foregoing in mind it is a primary object of the present invention to provide a new and improved method of transmitting measured or measuring values in a monitoring system which is not associated with the aforementioned limitations and drawbacks of the prior methods.

Another and more specific object of the present invention aims at providing an improved method of transmitting measured values in a monitoring system which requires very little installational expense, yet provides for positive identification of the measuring stations which transmit the measured values to a central signal station.

A further significant object of the present invention is directed to the provision of a new and improved method of transmitting measured values in a monitoring system which enables the use of identical measuring stations in a cascade connection to the central signal station and at the same time ensures positive identification of the measuring stations.

Another important object of the present invention is directed to a new and improved method of transmitting measured or measuring values in a monitoring system in which the measuring stations can be controlled by the central signal station from both sides via signal lines arranged in loops.

Now in order to implement these and still further objects of the invention, which will become more readily apparent as the description proceeds, the method of the present development is manifested by the features that, address storages which are present at the measuring stations are charged by the central signal station with the addresses of the corresponding measuring stations in a predetermined sequence and then become locked or blocked therein prior to the next following measuring station on the same signal line becoming connected to the signal voltage by the switching elements.

Thus, identical measuring stations are sequentially connected to the central signal station as in accordance with the cascade connection principle, i.e. a switching element is present at each measuring station in order to successively connect the measuring stations to the central signal station upon placing the monitoring system into operation. By means of the switching elements individual addresses can be read-in into the respective address storages of the measuring stations by the central signal station.

The address storage of the newly connected or reconnected measuring station or location is charged or filled and then immediately locked, i.e. blocked for the read-in of further addresses. The switching element simultaneously connects the next following measuring station to the signal line and this further measuring station is now ready to receive its associated address. The connection of further measuring stations is continued until all measuring stations associated with a signal line have been furnished with their associated individual addresses. Consequently, there is achieved the result that the originally identical measuring stations, after activation, differ from each other. Remote addressing prevents any manipulation at the site of the measuring stations and permits utilization of advantages of the system with parallel connections as well as the advantages of a system with series connection without having the disadvantages of the latter. It will be self-evident that in case of system failure, malfunction or maintenance the addresses can be read-in anew at any time.

The origin of the signal, i.e. the measuring station from which the signals originate, can be identified in the central signal station in accordance with two methods. According to the first method the stepping pulses are counted, and according to the second method the address of the measuring station serves for identification. By a combination of the two methods, i.e. by comparing the number of counted pulses with the address of the measuring station a very high degree of operational integrity is achieved in the identification of the measuring stations.

The measured or measuring values can now be transmitted in the manner described in the aforementioned German Pat. No. 2,533,382, i.e. the switching elements are operated during each interrogation cycle. However, the measured values also can be transmitted in the manner of a system with parallel transmission in which the switching elements remain closed.

An apparatus for carrying out the method according to the invention is composed of measuring stations each comprising a sensor for the related measured value, a measured value transducer, a control unit, an address storage and a switching element.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Describing now the drawings, it is to be understood that only enough of the construction of the measuring stations or, respectively, of the monitoring system has been shown as needed for those skilled in the art to readily understand the underlying principles and concepts of the present development, while simplifying the showing of the drawings. Turning attention now specifically to FIG. 1, there has been schematically illustrated in a block diagram the structure of a conventional or prior art monitoring system operating in accordance with the cascade or tandem connection principle. One or a number of signal lines L extend from a central signal station Z and a number of measuring stations MS are connected to each of the signal lines L. Each measuring station MS essentially comprises a signal receiver, an operational control, a signal generator and a switching element $S_m$ in addition to the measuring sensors and the measured or measuring value transducers. After application of the line voltage to the signal line L a timing element starts to run at the first measuring station $MS_1$. After a predetermined time-delay the switching element $S_1$ thereof closes and applies the line voltage to the second measuring station $MS_2$ at which also a timing element starts to run. In this way all switching elements at the measuring stations MS associated with a signal line L close one after the other. This operation may be periodically repeated so that all measuring stations MS on a signal line L are cyclically interrogated. After application of the line voltage to a measuring station MS or, respectively, after closure of the associated switching element S the measured value measured by the measuring sensor thereof can be transmitted to the central signal station Z.

Storage capacitors are located at the measuring stations MS and ensure for the power supply of the measuring stations MS during eventually occurring voltage interruptions due to the system.

Figure 1:
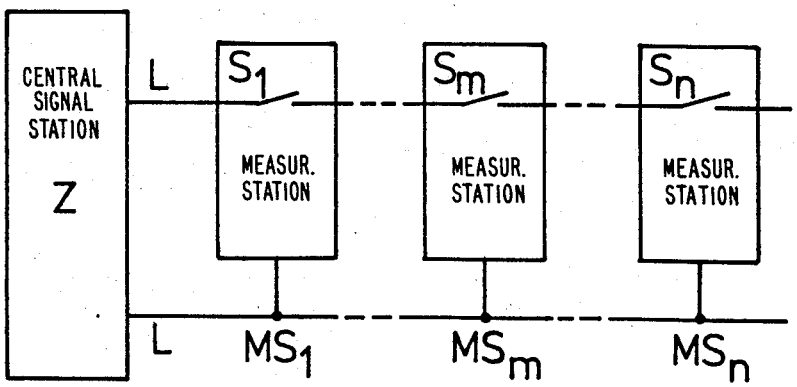
Fig.1 (PRIOR ART)
FIG. 1 is a schematic diagram of a prior art monitoring system containing series and cascade connected measuring stations.
Figure 2:
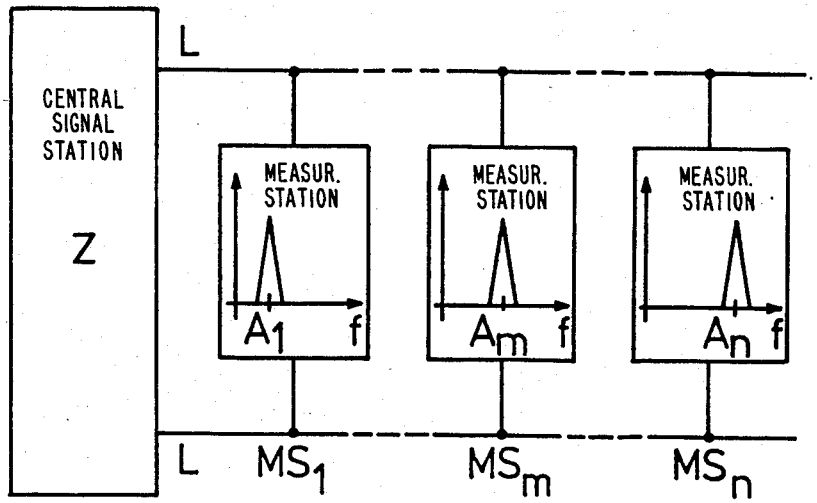
Fig.2 (PRIOR ART)
FIG. 2 is a schematic diagram of a prior art monitoring system containing measuring stations which are addressed in parallel.

FIG. 2 shows a block diagram of a conventional or prior art monitoring system working with parallel addressing. The individual measuring stations MS of the entire system are distributed over different signal lines L as in FIG. 1 and are connected via the signal lines L to a central signal station Z. Each signal line L comprises a two-wire line or conductor to which all the measuring stations MS associated with that signal line L are connected in parallel. Each measuring station MS is characterized by a fixedly adjusted or set address $A_m$. By transmitting the characteristic address $A_m$ the central signal station Z can call any one of the measuring stations MS and can cause the same, for example, to transmit its corresponding measured value. The address signals may comprise, for example, a digital pulse sequence, a defined voltage, frequency or tone sequence or any optional combination of such elements. In case of a larger number of measuring stations MS connected to each signal line L practically only a digital pulse sequence will be considered, because through the use thereof nearly any number of different addresses can be realized using elements of modest absolute accuracy and suited to be integrated. Additionally, even complicated instructions can be transmitted to the respectively addressed measuring stations MS by other digital pulse sequences.

It is an evident disadvantage of the parallel-connection system as described hereinbefore that the measuring stations are liable to be confused and that faulty addressing can be retraced only with difficulty. Additionally, the entire signal line will become inoperative in the case of a line short-circuit.

Figure 3:
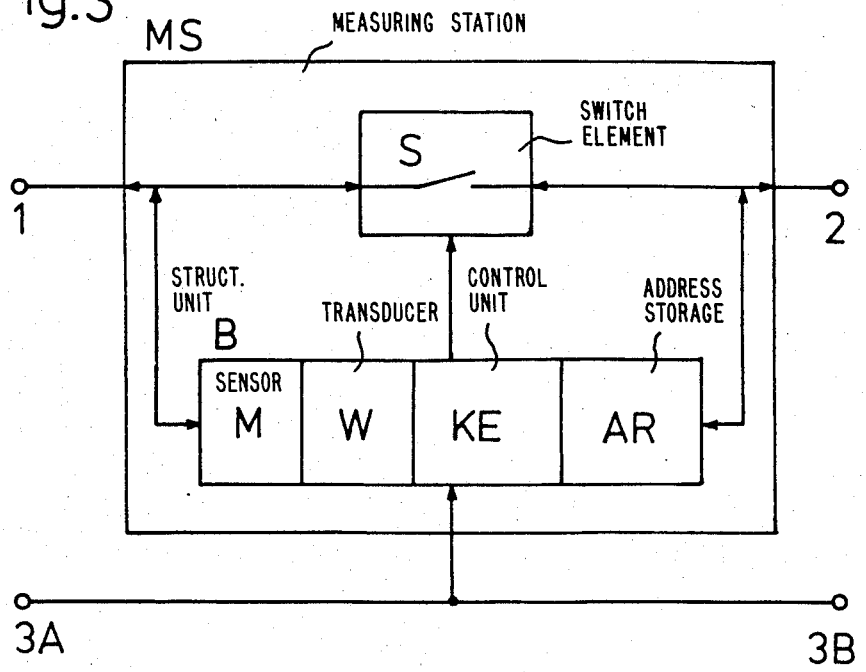
FIG. 3 is a block diagram of a measuring station for carrying out the method according to the present invention.

A block circuit diagram of a measuring station MS to be used with the transmitting method according to the invention is shown in FIG. 3.

The measuring station MS may be a fire detector or alarm like, for example, an ionization smoke detector, an optical smoke detector, a temperature detector or a flame detector, or it may be a monitoring device in an intrusion protective system like, for example, a passive infrared detector, an ultrasonic detector or a noise detector, or it may be any random measuring station in a transmitting system.

At each measuring station MS there is present a directionally symmetric or bilateral switching or switch element S interconnecting the two input-output terminals 1, 2. In the structural unit or component B there are provided a sensor M for the quantity or magnitude to be measured, a measured or measuring value transducer W, a control unit or device KE and an address storage AR.

The state of the switching element S is controlled by the control unit KE which also includes appropriate means for signal identification. Upon activation of the monitoring system, i.e. upon connecting the relevant measuring station MS to the central signal station Z via the line L a connection is made to the line voltage and the control unit KE detects the address A which is superposed on the line voltage and reads-in such address A into the address storage AR. In addition to the address A any other desired individual commands or information can be stored in the measuring station MS; however, the address storage AR is blocked for the read-in of further addresses A.

Figure 4:
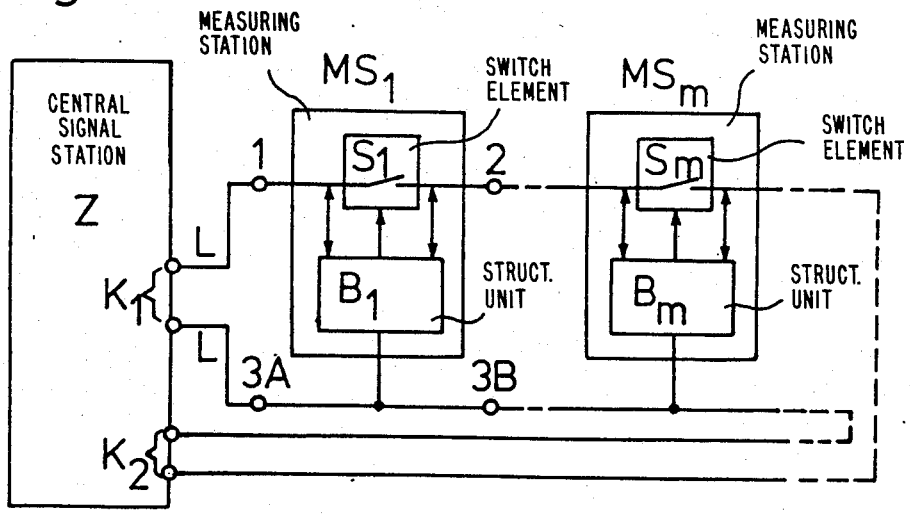
FIG. 4 is a schematic circuit diagram of a monitoring system working with remote addressing of the measuring stations by a central signal station and operated by the method according to the invention.

The measuring stations MS are interconnected with one another and connected to the central signal station Z via the terminals 1 and 3A, on the one hand, and via the terminals 2 and 3B on the other hand, as shown in FIG. 4.

Since the switching element S is directionally symmetrically or bilaterally designed current may be supplied to the measuring stations MS from both sides, i.e. the signal lines L may be connected to the measuring station MS via the terminals 1 and 3A as well as via the terminals 2 and 3B which constitutes a simplification and an increase in the safety or reliability of correct assembly of the system. On the other hand, the direction of the interrogation sequence for the affected signal line L may be reversed in the event of absence of detector signals by leading back the signal line L from the last measuring station MS to the central signal station Z.

The measuring station MS remotely addressed in this way is characterized by the stored address A until there is either a failure in the voltage supply to the measuring station MS or the central signal station Z eliminates the locking or blocking of the address storage by means of special control commands for the purpose of re-addressing the same and a new address is read-in. High reliability of identification of measured or measuring values is achieved if the address A is transmitted together with the measured value to the central signal station Z which thus can monitor the function of the measured value transmission by comparing the expected address with the actually read address.

Furthermore the control unit KE contains a respective line short-circuit detector, one for the left-hand and one for the right-hand connection terminal. When a short-circuit is detected the switching element S is opened in order to prevent the voltage at the non-short-circuited terminal from dropping below the required operational voltage. It is thus possible to maintain the operation of all the measuring stations MS until the line is short-circuited.

The measuring stations MS are symmetrical, i.e. exchangeable with respect to the connection terminals. A preferred embodiment of the method according to the invention provides that the line of a signal line L which extends from the last measuring station MS in a given sequence is led back to the central signal station Z. The measuring station MS can now be monitored on two sides. Consequently, in conjunction with the short-circuit detector as mentioned hereinbefore, it becomes possible to fully maintain the data traffic from and to the measuring stations MS with simultaneous indication of a line failure in case of a short-circuit or interruption in the line. It is of considerable significance in this context that the location of a line failure or malfunction can be readily detected by using the method teachings of the invention. This is a specific advantage since it is generally known that the detection of line failures is very expensive and time-consuming.

FIG. 4 is a block circuit diagram of a monitoring system for carrying out the method according to the invention; the system includes measuring stations MS which are addressed by the central signal station Z. As already explained with reference to FIG. 1 all the measuring stations MS are distributed over one or a number of signal lines L. The measuring stations MS are designed as explained with reference to FIG. 3, i.e. the measuring stations MS include in each structural unit or component B a measuring sensor M, a measured value transducer W, a control unit KE and an address storage AR for storing the address associated with the respective measuring station and other individual commands. Upon activation, at first all switching or switch elements S are opened so that only the measuring station $MS_1$ of a signal line L which is situated closest to the central signal station Z can receive information or data transmitted thereby. The central signal station Z now supplies the address $A_1$ to the signal line L which is then received by the measuring station $MS_1$ and which is read-in into its address storage $AR_1$. On this occasion control commands for the measuring station $MS_1$ also can be transmitted and read-in into corresponding storages or memories and stored therein. After receiving the address $A_1$ including eventually associated control commands the switching element $S_1$ is closed, so that the measuring station $MS_2$ can receive the correspondingly associated information from the central signal station Z. Simultaneous with the closure of the switching element $S_1$ also the address storage $AR_1$ and eventually present command storages are locked or blocked in such a manner that no further information can be read-in into the aforementioned storages. This operating cycle is repeated until all the measuring stations MS of the system are provided with addresses A and associated control commands, i.e. all measuring stations MS have been automatically and remotely addressed by the central signal station Z.

The fully addressed system now can be operated like any conventional monitoring system operating according to the cascade connection principle as illustrated in FIG. 1. Accordingly, a current pulse is generated each time a switching element S at a measuring station MS closes and the current pulse is counted at the central signal station Z for the purpose of identifying the measuring stations. Different from the function of the system shown in FIG. 1 the relevant address A is transmitted together with the measured value to the central signal station Z in coded form; therein the address A is compared to the address independently determined by counting the current pulses. By such a redundance the identification of the measuring station becomes very highly reliable.

It will be self-evident that such a monitoring system, when the remote addressing operation is concluded, may also be operated like the parallel-connection system as shown in FIG. 2. No addresses will have to be adjusted or set manually in such a system at the measuring stations since this is effected by the central signal station Z. Furthermore, the remotely addressed system may be operated as a mixed or hybrid series and parallel connected system.

While there are shown and described present preferred embodiments of the invention, it is to be distinctly understood that the invention is not limited thereto, but may be otherwise variously embodied and practiced within the scope of the following claims.

Accordingly, what we claim is:

1. In a method of transmitting measured values in a monitoring system containing individual measuring stations cascade connected by signal lines to a central signal station, each measuring station containing at least one switching element and at least one address storage, comprising the steps of:

(a) applying a voltage to said signal lines in order to disconnect all of the measuring stations from said signal lines;

(b) charging the address storage of a predetermined one of said measuring stations with a predetermined address by means of said central signal station;

(c) closing the switching element of said predetermined one of said measuring stations in order to lock said charged address in the address storage of said predetermined one of the measuring stations and to connect a following measuring station with said central signal station; and (d) repeating the foregoing steps (b) and (c) for successive ones of said measuring stations until said successive ones of the measuring stations are charged with predetermined addresses.

2. In a method of transmitting measured values in a monitoring system containing individual monitoring measuring stations cascade connected via signal lines to a first pair of terminals of a central signal station, each measuring station being provided with at least one switching element and at least one address storage, comprising the steps of:

applying a voltage signal to the signal lines in order to disconnect all of the measuring stations from the central signal station;

applying by means of said central signal station in a timewise staggered succession respective predetermined addresses to said measuring stations by respectively infeeding said predetermined addresses into the respective address storages of said measuring stations; and blocking the applied address in each address storage before a next following measuring station is reconnected with the signal lines.

3. The method as defined in claim 2, wherein:

the step of blocking the applied address in each address storage entails actuating the switching element of the measuring station where the address is to be blocked in the address storage thereof.

4. The method as defined in claim 3, further including the step of:

utilizing closing of the switching element of any predetermined one of said measuring stations in order to block the address stored in the address storage thereof and to reconnect the next following measuring station with the signal lines.

5. The method as defined in claim 2, further including the step of:

initially charging that one of said address storages associated with that one of said measuring stations which is located closest to said central signal station.

6. The method as defined in claim 2, further including the step of:

initially charging that one of said address storages associated with that one of said measuring stations which is located furthest from said central signal station.

7. The method as defined in claim 2, further including the step of:

directionally symmetrically connecting said measuring stations to said signal lines.

8. The method as defined in claim 7, further including the steps of:

connecting the signal lines extending from a last one of said measuring stations to a second pair of terminals; and selectively activating said measuring stations via said central signal station either via said first or via said second pairs of terminals.

9. The method as defined in claim 2, further including the step of:

after charging all said address storages associated with all said measuring stations closing all said switching elements in order to connect all said measuring stations in parallel to said central signal station.

10. The method as defined in claim 2, further including the step of:

incorporating in each of said measuring stations control means for detecting a short-circuit in pairs of terminals of each said measuring station and to which said measuring stations are connected via said signal lines.

* * * * *